US008499687B2

(12) United States Patent
Gygy et al.

(10) Patent No.: US 8,499,687 B2
(45) Date of Patent: Aug. 6, 2013

(54) CYLINDER BODY FOR ORIENTING MAGNETIC FLAKES CONTAINED IN AN INK OR VARNISH VEHICLE APPLIED ON A SHEET-LIKE OR WEB-LIKE SUBSTRATE

(75) Inventors: Matthias Gygy, Schmitten (CH); Johann Emil Eitel, Thüngen (DE); Gabriel Hermann, Etagnières (CH); Alain Jufer, L'Isle (CH)

(73) Assignee: KBA-Notasys SA, Lausanne (CH)

( * ) Notice: Subject to any disclaimer, the term of this patent is extended or adjusted under 35 U.S.C. 154(b) by 628 days.

(21) Appl. No.: 12/527,580

(22) PCT Filed: Feb. 19, 2008

(86) PCT No.: PCT/IB2008/050592

§ 371 (c)(1), (2), (4) Date: Mar. 22, 2010

(87) PCT Pub. No.: WO2008/102303

PCT Pub. Date: Aug. 28, 2008

(65) Prior Publication Data

US 2010/0170408 A1 Jul. 8, 2010

(30) Foreign Application Priority Data

Feb. 20, 2007 (EP) ..... 07102749

(51) Int. Cl.
*B41L 13/04* (2006.01)

(52) U.S. Cl.
USPC ..... 101/116; 101/216; 101/489; 492/8; 492/39

(58) Field of Classification Search
USPC ..... 101/389.1, 489; 492/8, 38, 39, 40
See application file for complete search history.

(56) References Cited

U.S. PATENT DOCUMENTS

| | | | | |
|---|---|---|---|---|
| 3,721,189 | A * | 3/1973 | Bray | 101/389.1 |
| 3,742,852 | A * | 7/1973 | Leffler et al. | 101/378 |
| 3,873,975 | A * | 3/1975 | Miklos et al. | 360/25 |
| 4,376,330 | A * | 3/1983 | Weidinger et al. | 492/7 |
| 4,838,648 | A | 6/1989 | Phillips et al. | |
| 5,671,671 | A | 9/1997 | Wyssmann et al. | |
| 5,839,366 | A | 11/1998 | Schaede | |
| 5,960,716 | A | 10/1999 | Schaede | |
| 6,109,172 | A | 8/2000 | Wyssmann | |
| 6,838,166 | B2 | 1/2005 | Phillips et al. | |
| 6,875,522 | B2 | 4/2005 | Seto et al. | |
| 7,047,883 | B2 | 5/2006 | Raksha et al. | |

(Continued)

FOREIGN PATENT DOCUMENTS

| | | |
|---|---|---|
| EP | 0 686 675 A1 | 12/1995 |
| EP | 0 723 864 A1 | 7/1996 |

(Continued)

*Primary Examiner* — Ren Yan

(74) *Attorney, Agent, or Firm* — Seager, Tufte & Wickhem LLC

(57) ABSTRACT

There is described a cylinder body (10) for orienting magnetic flakes contained in an ink or varnish vehicle applied on a sheet-like or web-like substrate, which cylinder body (10) has a plurality of magnetic-field-generating devices (50, 60) disposed on an outer circumference of the cylinder body (10). The cylinder body (10) comprises a plurality of distinct annular supporting rings (40) distributed axially along a common shaft member (20), each annular supporting ring (40) carrying a set of magnetic-field-generating devices (50, 60) which are distributed circumferentially on an outer circumference of the annular supporting rings (40).

19 Claims, 13 Drawing Sheets

(56) References Cited

U.S. PATENT DOCUMENTS

| | | | |
|---|---|---|---|
| 7,258,900 | B2 | 8/2007 | Raksha et al. |
| 7,287,467 | B2 | 10/2007 | Stöhr |
| 7,458,319 | B2 | 12/2008 | Stöhr |
| 7,517,578 | B2 | 4/2009 | Raksha et al. |
| 2003/0170471 | A1 | 9/2003 | Seto et al. |
| 2004/0009309 | A1 | 1/2004 | Raksha et al. |
| 2004/0028905 | A1 | 2/2004 | Phillips et al. |
| 2004/0051297 | A1 | 3/2004 | Raksha et al. |
| 2005/0106367 | A1 | 5/2005 | Raksha et al. |
| 2005/0160925 | A1 | 7/2005 | Stohr |
| 2006/0081151 | A1 | 4/2006 | Raksha et al. |
| 2006/0150854 | A1 | 7/2006 | Benninger et al. |
| 2006/0219107 | A1 | 10/2006 | Gygi |
| 2007/0172261 | A1 | 7/2007 | Raksha et al. |
| 2007/0193462 | A1 | 8/2007 | Schaede |
| 2007/0261575 | A1 | 11/2007 | Stohr |
| 2008/0271631 | A1 | 11/2008 | Hoier et al. |

FOREIGN PATENT DOCUMENTS

| | | | |
|---|---|---|---|
| EP | 0 769 376 | A1 | 4/1997 |
| EP | 0 686 675 | B1 | 2/1998 |
| EP | 1 650 042 | A1 | 4/2006 |
| EP | 1 810 756 | A2 | 7/2007 |
| WO | 97/29912 | A1 | 8/1997 |
| WO | 97/34767 | A1 | 9/1997 |
| WO | 02/073250 | A2 | 9/2002 |
| WO | 03/000801 | A2 | 1/2003 |
| WO | 03/093013 | A2 | 11/2003 |
| WO | 2004/007095 | A2 | 1/2004 |
| WO | 2004/007096 | A2 | 1/2004 |
| WO | 2004/096545 | A2 | 11/2004 |
| WO | 2005/000585 | A1 | 1/2005 |
| WO | 2005/002866 | A1 | 1/2005 |
| WO | 2005/095109 | A1 | 10/2005 |
| WO | 2005/102699 | A1 | 11/2005 |

* cited by examiner

CYLINDER BODY FOR ORIENTING MAGNETIC FLAKES CONTAINED IN AN INK OR VARNISH VEHICLE APPLIED ON A SHEET-LIKE OR WEB-LIKE SUBSTRATE

TECHNICAL FIELD

The present invention generally relates to a cylinder body for orienting magnetic flakes contained in an ink or varnish vehicle applied on a sheet-like or web-like substrate, which cylinder body comprises a plurality of magnetic-field-generating devices disposed on an outer circumference of the cylinder body. The present invention is especially applicable in the context of the production of security documents, such as banknotes. The present invention also relates to a printing press comprising such a cylinder body.

BACKGROUND OF THE INVENTION

A printing press comprising such a cylinder body for orienting magnetic flakes is known as such in the art. Such a printing press is for instance disclosed in International application No. WO 2005/000585 filed in the name of the present applicant.

One embodiment of a sheet-fed printing press disclosed in International application No. WO 2005/000585 is represented in FIG. 1. This printing press is adapted to print sheets according to the silk-screen printing process and comprises a feeding station 1 for feeding successive sheets to a silk-screen printing group 2 where silk-screen patterns are applied onto the sheets. In this example the printing group 2 comprises an impression cylinder 2*a* cooperating with two screen cylinders 2*b*, 2*c* placed in succession along the printing path of the sheets. Once processed in the printing group 2, the freshly printed sheets are transported by means of a conveyor system 3 to a delivery station 4 comprising a plurality of delivery pile units, three in this example. The conveyor system 3 is typically an endless chain conveyor system comprising a plurality of spaced-apart gripper bars (not shown in FIG. 1) extending transversely to the sheet transporting direction, each gripper bar comprising clamping means for holding a leading edge of the sheets.

In the example illustrated in FIG. 1, a cylinder 10 carrying a plurality of magnetic-field-generating devices is located along the path of the sheets carried by the chain conveyor system 3. This cylinder 10 is designed to apply a magnetic field to selected locations of the sheets for the purpose of orienting magnetic flakes contained in the patterns of ink or varnish which have been freshly-applied on the sheets in the printing group 2. A drying or curing unit 5 is provided downstream of the cylinder 10 for drying, respectively curing, the ink/varnish applied onto the sheets after the magnetic flakes have been oriented, such unit 5 being typically an infrared drying unit or a UV curing unit depending on the type of ink or varnish used.

Further details regarding silk-screen printing presses, including relevant details of the silk-screen printing press illustrated in FIG. 1, can be found in European patent applications EP 0 723 864, EP 0 769 376 and in International applications WO 97/29912, WO 97/34767, WO 03/093013, WO 2004/096545, WO 2005/095109 and WO 2005/102699, all incorporated by reference to this effect in the present application.

Silk-screen printing is in particular adopted, in the context of the production of security documents, such as banknotes, to print optically-variable patterns onto the documents, including so-called iridescent patterns and OVI® patterns (OVI® is a registered trademark of SICPA Holding SA, Switzerland). Such patterns are printed using inks or varnishes containing special pigments or flakes producing optically variable effects.

So-called "magnetic flakes" are also known in the art, which magnetic flakes have the particularity that they can be oriented or aligned by an appropriately-applied magnetic field. Such magnetic flakes and method for orienting such magnetic flakes are discussed in particular in U.S. Pat. No. 4,838,648, European patent application EP 0 686 675, and International applications WO 02/073250, WO 03/000801, WO 2004/007095, WO 2004/007096, WO 2005/002866, all incorporated by reference to this effect in the present application.

The most convenient method to apply the above magnetic flakes is by silk-screen printing as discussed in the above-mentioned International application WO 2005/000585. This is mainly due to the fact that the flakes have a relatively important size which restricts the choice of available printing processes for applying inks or varnishes containing such flakes. In particular, one has to ensure that the flakes are not destroyed or damaged during the printing process, and silk-screen printing constitutes the most convenient printing process to achieve this goal. Furthermore, silk-screen printing has the advantage that the inks or varnishes used exhibit a relatively low viscosity which favours proper orientation of the magnetic flakes.

Nevertheless, other printing processes could be envisaged to apply inks and varnishes containing magnetic flakes. In European patent application EP 1 650 042, it is for instance proposed to apply such magnetic flakes in an intaglio printing process, whereby the paste-like intaglio ink containing the flakes is heated to decrease the viscosity of the ink and thereby allow the flakes to be oriented more easily. This can be performed in a conventional intaglio printing press, since the plate cylinder of such presses is commonly brought to an operating temperature of approximately 80° C. during printing operations.

Orientation of the magnetic flakes is carried out by applying an adequate magnetic field to the freshly-applied ink or varnish containing the magnetic flakes. By appropriately shaping the field lines of the magnetic field, as for instance discussed in the above-mentioned patent publications, the magnetic flakes can be aligned in any desired pattern producing a corresponding optically-variable effect which is very difficult, if not impossible to counterfeit.

As already mentioned hereinabove, an adequate solution for orienting the magnetic flakes consists in bringing the sheets in contact with a rotating cylinder carrying a plurality of magnetic-field-generating devices.

Referring again to FIG. 1, and as discussed in International application No. WO 2005/000585, the cylinder 10 could alternatively be located at the sheet transfer location 3*a* between the impression cylinder 2*a* and the conveyor system 3. Still according to another embodiment envisaged in International application No. WO 2005/000585, the impression cylinder 2*a* itself could be designed as a cylinder carrying magnetic-field-generating devices.

In the embodiment illustrated in FIG. 1, the cylinder 10 used to orient the magnetic flakes advantageously cooperates with the non-freshly-printed side of the sheets, thereby preventing smearing problems, the magnetic field being applied from the back side of the sheets through the freshly-printed patterns of ink or varnish. During orientation of the magnetic flakes, i.e. at the time when a sheet carried by the conveyor system 3 contacts the upper part of the circumference of the cylinder 10, the cylinder 10 is rotated at a circumferential speed corresponding to the speed of the transported sheets so that there is no relative displacement between the transported sheets and the circumference of the cylinder. As illustrated, the cylinder 10 is placed in the path of the chain conveyor system 3 such that the sheets follow a curved path tangential to the outer circumference of the cylinder 10, thereby enabling part of the surface of the processed sheet to be brought in contact with the outer circumference of the cylinder 10.

In the context of the production of banknotes, in particular, each printed sheet (or each successive portion of a continuous web, in case of web-printing) carries an array of imprints arranged in a matrix of rows and columns, which imprints ultimately form individual securities after final cutting of the sheets or web portions. The cylinder used to orient the magnetic flakes is therefore typically provided with as many magnetic-field-generating devices as there are imprints on the sheets or web portions.

The format and/or layout of the printed sheets (or successive web portions) depends on each case, in particular on the dimensions of each individual imprint and the number thereof. This means that the magnetic cylinder must be configured accordingly.

There is therefore a need for an adaptable cylinder configuration which enables quick adaptation thereof to a new format and/or layout of the printed substrate.

SUMMARY OF THE INVENTION

An aim of the invention is therefore to improve the known devices by providing a solution enabling and facilitating adjustment of the cylinder used to orient magnetic flakes to the actual format and/or layout of the printed sheets or of the successive web portions.

A further aim of the present invention is to provide a solution that can easily be installed in a printing press, without this requiring major modifications of the printing press.

Still another aim of the present invention is to provide a solution that guarantees a proper register between the magnetic-field-generating devices of the cylinder and the imprints on the sheets or web portions.

Yet another aim of the present invention is to ensure a stable support of the sheets or web portions during orientation of the magnetic flakes.

These aims are achieved thanks to the solution defined in the claims.

According to the invention, the cylinder body comprises a plurality of distinct annular supporting rings distributed axially along a common shaft member, each annular supporting ring carrying one set of magnetic-field-generating devices which are distributed circumferentially on an outer circumference of the annular supporting ring.

Thanks to this cylinder configuration, both axial and circumferential adjustment of the position of the magnetic-field-generating devices can be performed quickly, axial adjustment being effected by adjusting the position of the corresponding annular supporting ring along the common shaft member, while circumferential adjustment is effected by adjusting the position of the magnetic-field-generating devices along the circumference of the corresponding annular supporting ring.

Preferably, each annular supporting ring is designed so as to be freely adjustable along the axis of the common shaft member, independently of the other annular supporting rings. Similarly, each magnetic-field-generating device is preferably freely adjustable along the circumference of the annular supporting rings, independently of the other magnetic-field-generating devices disposed on the same annular supporting ring.

According to an advantageous embodiment, each annular supporting ring has a generally annular shape interrupted by a radial opening slit and is provided with assembly means acting on the radial opening slit for securing or releasing the annular supporting ring to or from the common shaft member.

According to a preferred embodiment, each annular supporting ring comprises an inner mounting groove extending parallel to an axis of rotation of the cylinder body for mounting on the common shaft member at a determined angular position about the common shaft member. This ensures that each annular supporting ring is positioned at a precise and common reference position about the axis of the common shaft member.

Still according to a preferred embodiment, a cover plate made of a material having a low magnetic permeability, such as aluminium or a non-magnetic stainless steel, is further provided, which cover plate is secured on the annular supporting rings and covers the magnetic-field-generating devices. This ensures that the cylinder body exhibits a substantially uniform outer circumference offering a good support for the processed sheets. Alternatively, intermediate rings could be disposed between the annular supporting rings to close the gaps therebetween.

In the context of the above-mentioned embodiment comprising a cover plate, it might be appropriate to provide openings in the cover plate at locations corresponding to the positions of the magnetic-field-generating devices, as some magnetic-field-generating devices might require to be disposed in close proximity with the processed ink/varnish patterns.

Still in the context of the above-mentioned embodiment comprising a cover plate, it is advantageous to additionally provide clamping means for securing and tensioning the cover plate around the annular supporting rings, thereby ensuring and guaranteeing a precise reference surface for the sheets.

According to yet another preferred embodiment, each magnetic-field-generating device comprises a supporting member mounted on the annular supporting ring for receiving a corresponding magnetic-field-inducing element. This enables to standardize the mounting of the magnetic-field-generating devices on the annular supporting rings, while allowing a quick replacement of the magnetic-field-inducing element, for instance when one wishes to replace one element by another element designed to produce a different optical effect, i.e. an element producing a different pattern of magnetic field lines. In the context of this embodiment, it is advantageous to provide each supporting member with its own clamping means for securing it to the annular supporting rings.

Mounting of the magnetic-field-generating devices is preferably ensured by a peripheral mounting groove provided on the circumference of the annular supporting ring, which peripheral mounting groove preferably exhibits an inverted-T shape. In this context, each annular supporting ring can advantageously be further provided with a pair of peripheral supporting shoulders extending on each side of the annular mounting groove, which supporting shoulders have a diameter such that the magnetic-field-generating devices are almost completely enclosed between the peripheral supporting shoulders.

According to still another preferred embodiment, the common shaft member is provided with a plurality of suction apertures distributed axially and circumferentially on an outer circumference of the common shaft member, which suction apertures communicate with corresponding suction outlets provided on the annular supporting and opening on the outer circumference of the annular supporting rings. This enables to appropriately aspirate the sheets or web against the outer circumference of the cylinder body during processing. In the preferred embodiment mentioned above where each annular supporting ring is provided with a pair of peripheral supporting shoulder, the suction outlets preferably extend and open on an outer circumference of the said supporting shoulders.

Advantageously, the suction apertures on the common shaft member are designed so as to be selectively closed by corresponding plug elements disposed (for instance by screwing) in said suction apertures.

By providing a plurality of independent suction channels extending axially along a length of the common shaft member, which independent suction channels communicate with a corresponding set of axially-distributed suction apertures of the common shaft member, and by designing each annular supporting ring so as to be provided with a plurality of inner independent suction chambers each communicating with a corresponding one of the independent suction channels of the common shaft member, one can advantageously ensure that suction is performed only at selected location of the circumference of the cylinder body, i.e. at the location where the sheet or web is contacting the circumference of the cylinder body. This guarantees that suction is applied only where necessary, thereby optimising the suction efficiency.

According to a possible implementation where the cylinder body is intended to cooperate with a chain gripper system of a sheet-fed printing press, a clearance is provided on part of the circumference of the annular supporting rings for receiving a protruding portion of a gripper bar of the chain gripper system. In alternate implementations, the cylinder body could be designed so as to be provided with its own sheet clamping means, in essentially the same manner as a conventional sheet-processing cylinder.

Advantageous embodiments of the invention form the subject-matter of the dependent claims and are discussed below. In particular, there is claimed a printing press, especially a silk-screen printing press, comprising a cylinder body according to the invention and wherein the cylinder body is located in a delivery section of the printing press.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 1:
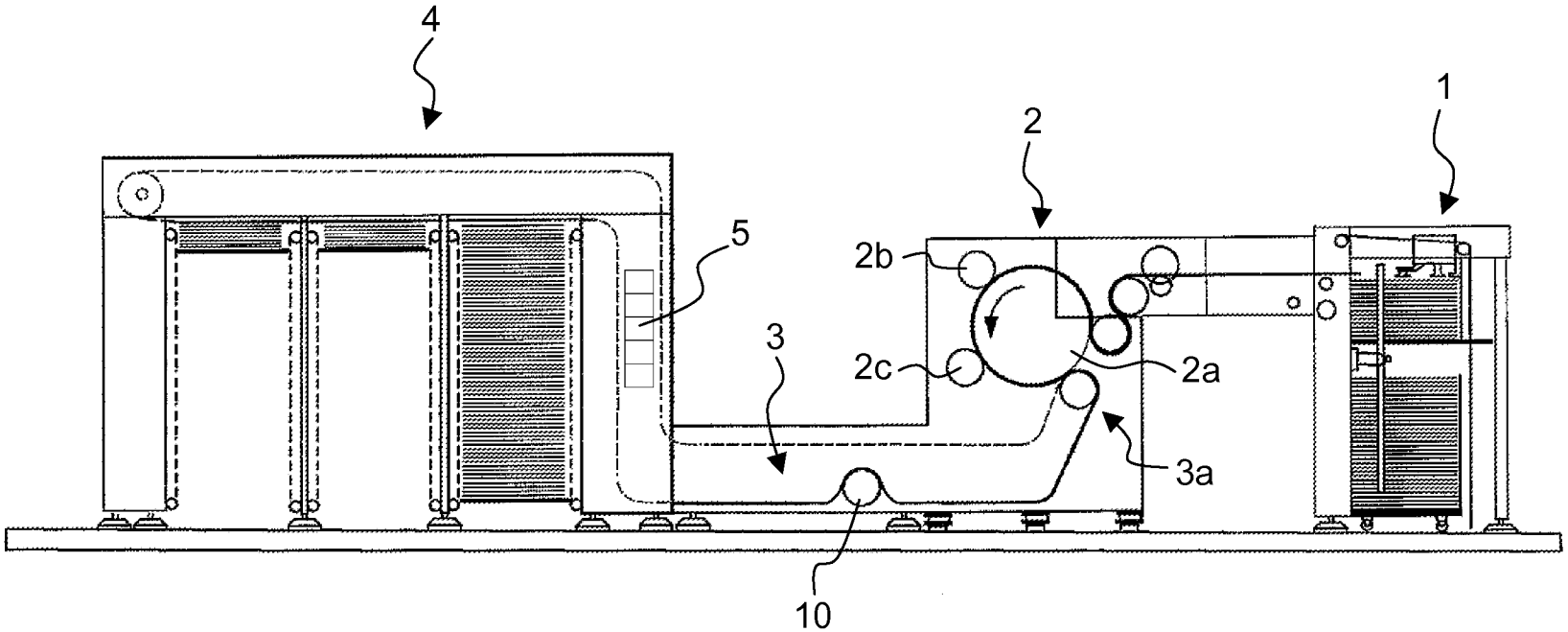
FIG. 1 is a side view of a sheet-fed silk-screen printing press incorporating a cylinder body according to the present invention.

The invention will be described hereinafter in the context of a sheet-fed silk-screen printing press for printing security papers, in particular banknotes. The silk-screen printing press may be a printing press as illustrated in FIG. 1 or any other type of silk-screen printing press. The illustrated embodiment shows a cylinder body which is in particular adapted for installation in the path of a chain conveyor system of the type comprising a plurality of spaced-apart grippers bars as already discussed hereinabove. The invention is equally applicable to any other cylinder configuration that could be installed between the printing group of a silk-screen printing press and the drying/curing unit thereof. For instance, according to a possible alternate embodiment of the invention, the cylinder body could be part of a processing unit comprising a plurality of processing cylinders each with its own sheet clamping means. In other words, while the illustrated embodiment shows a cylinder body adapted for cooperating with a chain conveyor system, this shall not as such be regarded as an aspect limiting the scope of the invention.

In addition, while the illustrated embodiment shows a cylinder body adapted for processing sheets, the processing of a continuous web is also envisaged as a possible implementation of the present invention.

Figure 2:
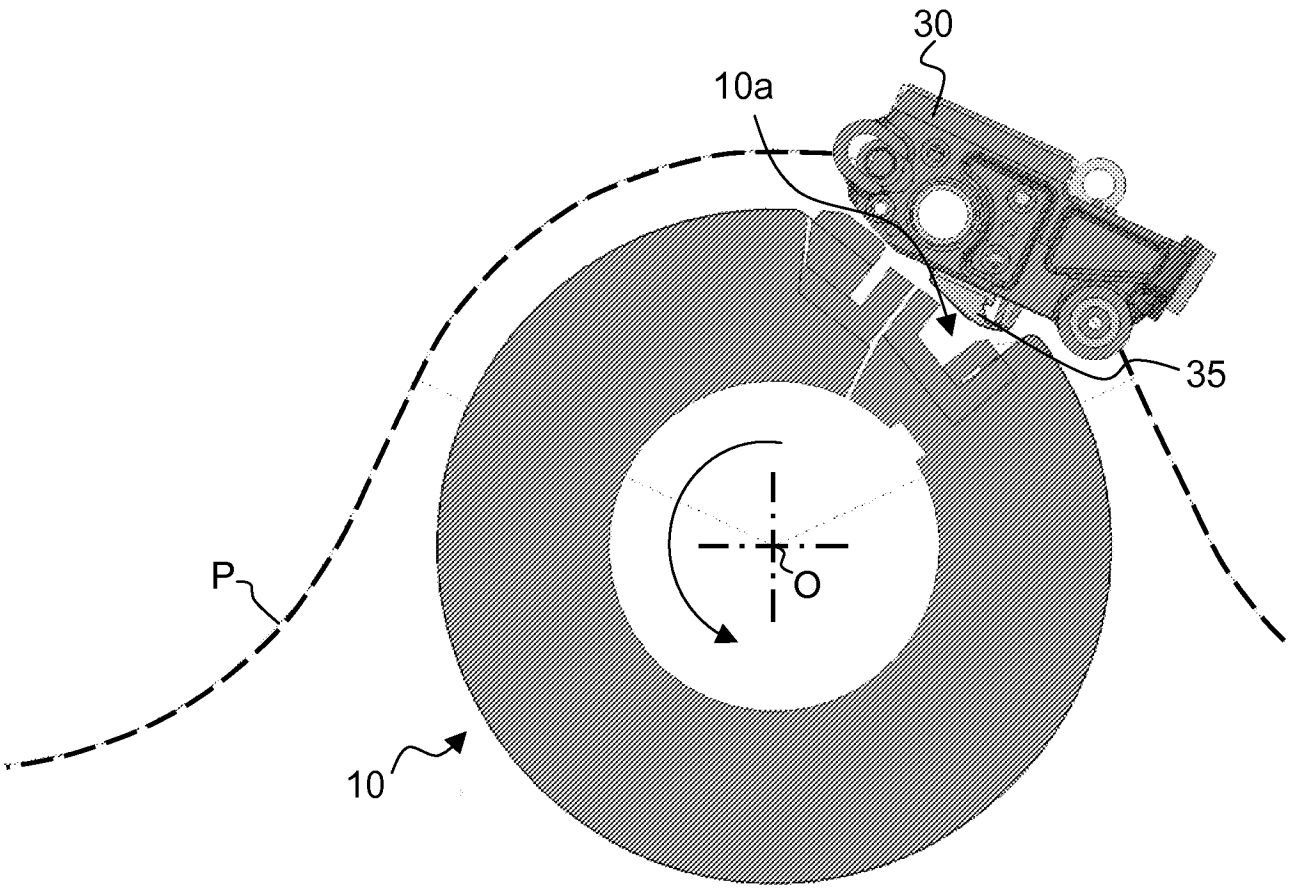
FIG. 2 is a schematic side view illustrating the cooperation of the cylinder body with a gripper bar of the chain conveyor system of the printing press of FIG. 1.

FIG. 2 is a schematic side view illustrating the cooperation of the cylinder body of the present invention, designated generally by reference numeral 10, with a gripper bar 30 of the conveyor system 3 of the printing press of FIG. 1. As illustrated in FIGS. 1 and 2, the conveyor system 3 is designed in such a way that each gripper bar 30 follows a curved path P (from right to left in the Figure) about the circumference of the cylinder body 10, which cylinder body 10 is made to rotate around its axis of rotation O (in a counter-clockwise direction as illustrated by the arrow in FIG. 2) in synchronism with the displacement of the gripper bar 30. More precisely, the cylinder body 10 is provided with a clearance 10*a* on its outer circumference that is dimensioned in such a way as to enable a protruding part of the gripper bar 30, namely the clamping elements 35 which hold a leading edge of a sheet, to be received in the said clearance and prevent interference with the gripper bar 30.

In this case, when a new sheet is arriving (i.e. in the configuration illustrated in FIG. 2), the cylinder body 10 is positioned in such a way that the clearance 10*a* is brought in front of the clamping elements 35 of the gripper bar 30. The cylinder body 10 is then briefly accelerated so as to catch up the gripper bar 30 and enable as close as possible a positioning of the cylinder body 10 with respect to the leading edge of the sheets. The main purpose of this brief acceleration of the cylinder body is to minimize the distance between the leading edge of the sheet which is clamped in the clamping elements 35 and the starting point on the circumference of the cylinder body 10, i.e. enable orientation of magnetic flakes at a location as close as possible to the leading edge of the sheets.

Once the cylinder body 10 has caught up the gripper bar 30, the cylinder body 10 is rotated at a speed such that there is no relative displacement between the gripper bar 30 and the outer circumference of the cylinder body 10. Such synchronized rotation of the cylinder body 10 continues for as long as the sheet being processed is in contact with the outer circumference of the cylinder body 10. The same process is then repeated for the subsequent sheet.

Figure 3:
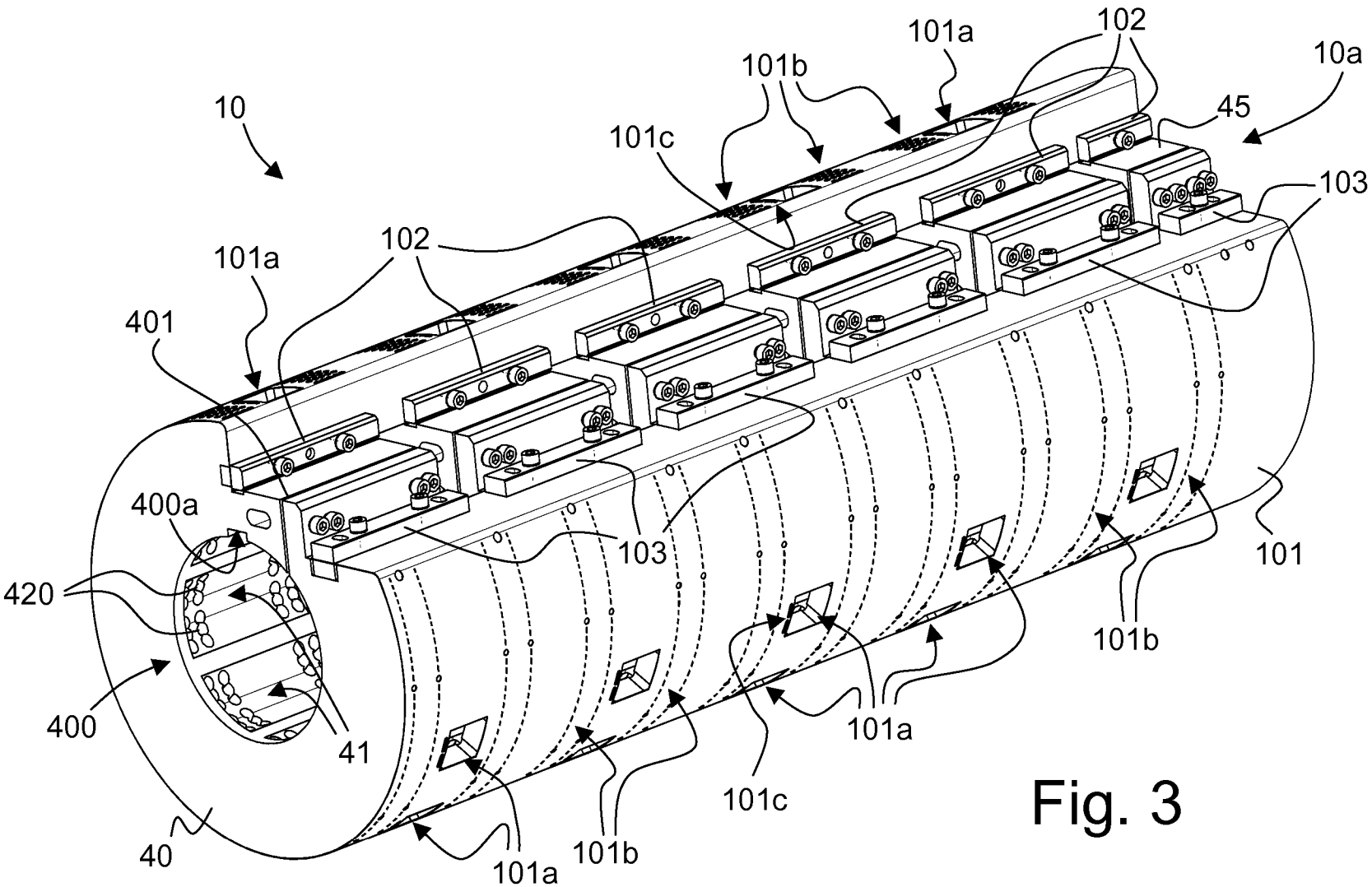
FIG. 3 is a schematic perspective view of a portion of a cylinder body according to one embodiment of the invention.
Figure 6A:
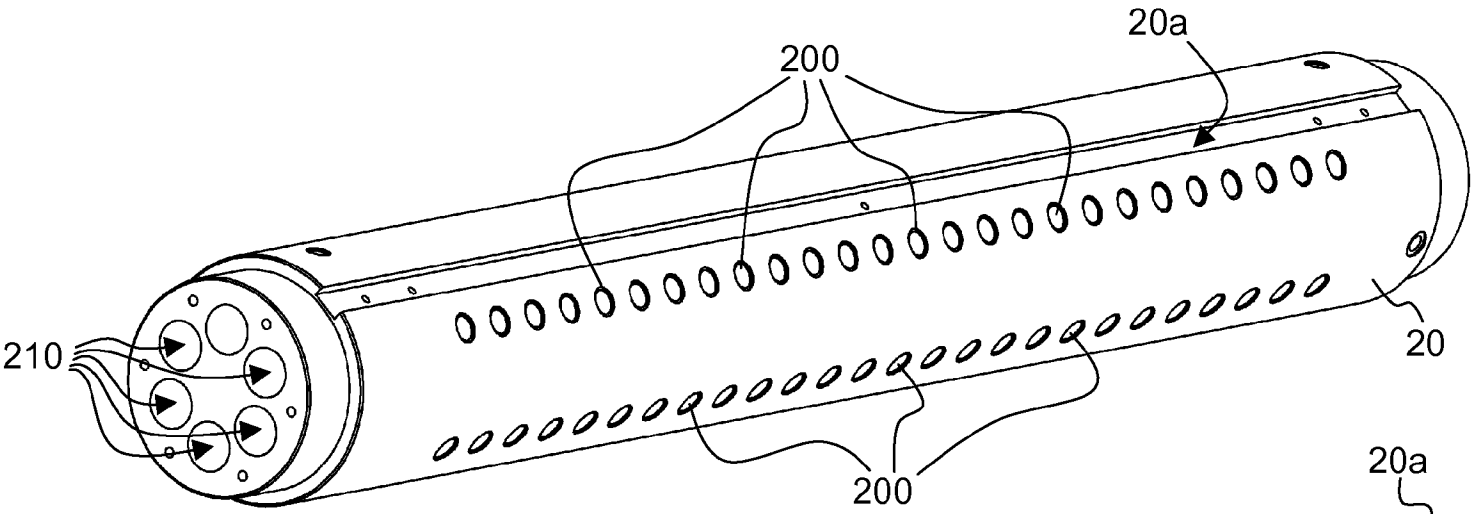
FIGS. 6*a* and 6*b* are respectively a perspective view and a cross-section of a common shaft member onto which the annular supporting rings of FIG. 4 are to be mounted.
Figure 6B:
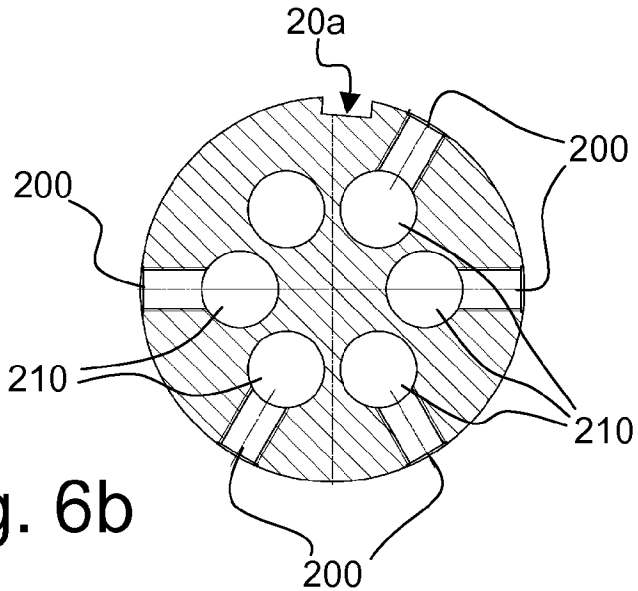

FIG. 3 is a perspective view of a portion of a cylinder body 10 according to one embodiment of the invention. A common shaft member has been omitted in this Figure, which common shaft member is illustrated in FIGS. 6*a* and 6*b* and will be discussed separately in the following description.

As shown in FIG. 3, the cylinder body 10 exhibits an essentially cylindrical outer shape with the clearance 10*a* extending axially over a length of the cylinder body 10. In this preferred example, a cover plate 101 is provided on an outer circumference of the cylinder body 10. This cover plate 101, which is made of material exhibiting a low magnetic permeability is advantageously clamped at both extremities in the region of the clearance 10*a*. Clamping means 102, 103 are provided for this purpose, which clamping means are designed to secure the cover plate 101 in an adequate manner on the outer circumference of the cylinder body 10. More precisely, the cover plate 101 is clamped at one end by first clamping bars 102 and at the other end by second clamping bars 103. While this is not shown in detail, the second clamping bars 103 are designed to be displaceable on the cylinder body 10 so as to adjust the tension of the cover plate 101.

As further illustrated in FIG. 3, the cover plate 101 is provided in this example with a plurality of rectangular openings 101*a*. The positions of these openings 101*a* is made to correspond to the positions of below-located magnetic-field-generating devices. The openings 101*a* are as such optional and are preferable in case use is made of a particular type of magnetic-field-generating devices, such as those described in WO 2005/002866 which are to be disposed preferably in close proximity with the ink/varnish pattern containing the magnetic flakes to be oriented. With other types of magnetic-field-generating devices, one might omit the openings 101*a*.

A plurality of small openings 101*b* visible on the upper part of FIG. 3 are further provided in this example along a plurality of annular lines shown as dashed lines in the lower part of FIG. 3. As this will become apparent in the following, these openings 101*b* communicate with a plurality of suction outlets located below the cover plate 101 and designed to permit aspiration of the processed sheet against the circumference of the cylinder body 10.

Figure 4:
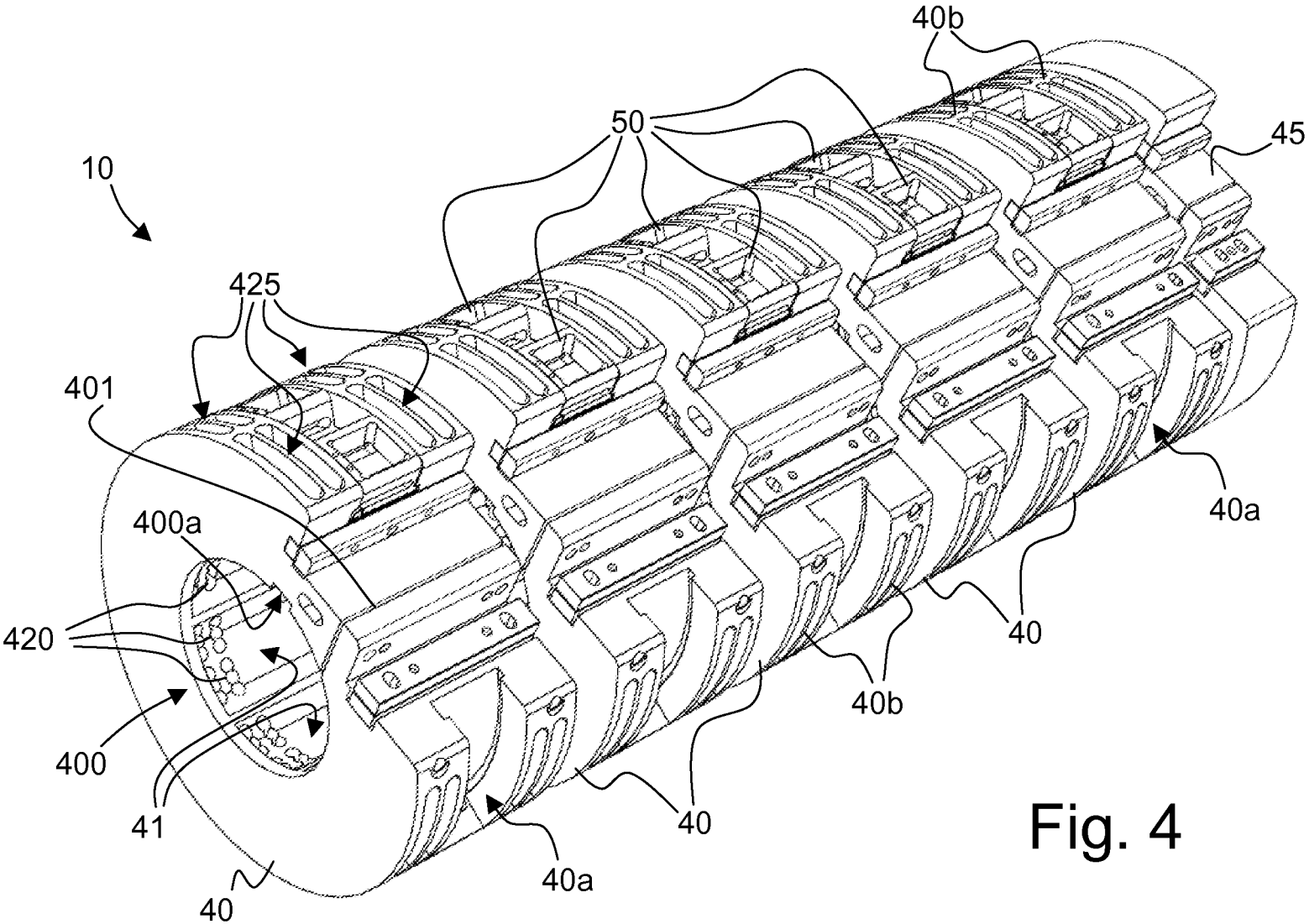
FIG. 4 is a schematic perspective view of annular supporting rings forming part of the first embodiment illustrated in FIG. 3.

FIG. 4 is a view of part of the cylinder body 10 illustrated in FIG. 3 without the cover plate 101. As this is visible in FIG. 4, the cylinder body 10 comprises a plurality of annular supporting rings 40 distributed axially along the axis of rotation of the cylinder body 10. In the illustrated example, five identical annular supporting rings 40 are provided. An additional ring 45 is provided at the outermost right extremity of the cylinder body 10. This additional ring 45 essentially fulfils the function of supporting the right-hand side of the cover plate 101 shown in FIG. 3 and provide symmetry to the overall cylinder body 10.

Each annular supporting ring 40 is preferably provided with a peripheral mounting groove 40*a* and a pair of peripheral supporting shoulders 40*b* extending on each side of the annular mounting groove 40*a*. A plurality of supporting members 50 are mounted on the peripheral mounting groove 40*a*, which supporting members 50 are designed to receive a corresponding magnetic-field-inducing element (not shown).

Figure 5:
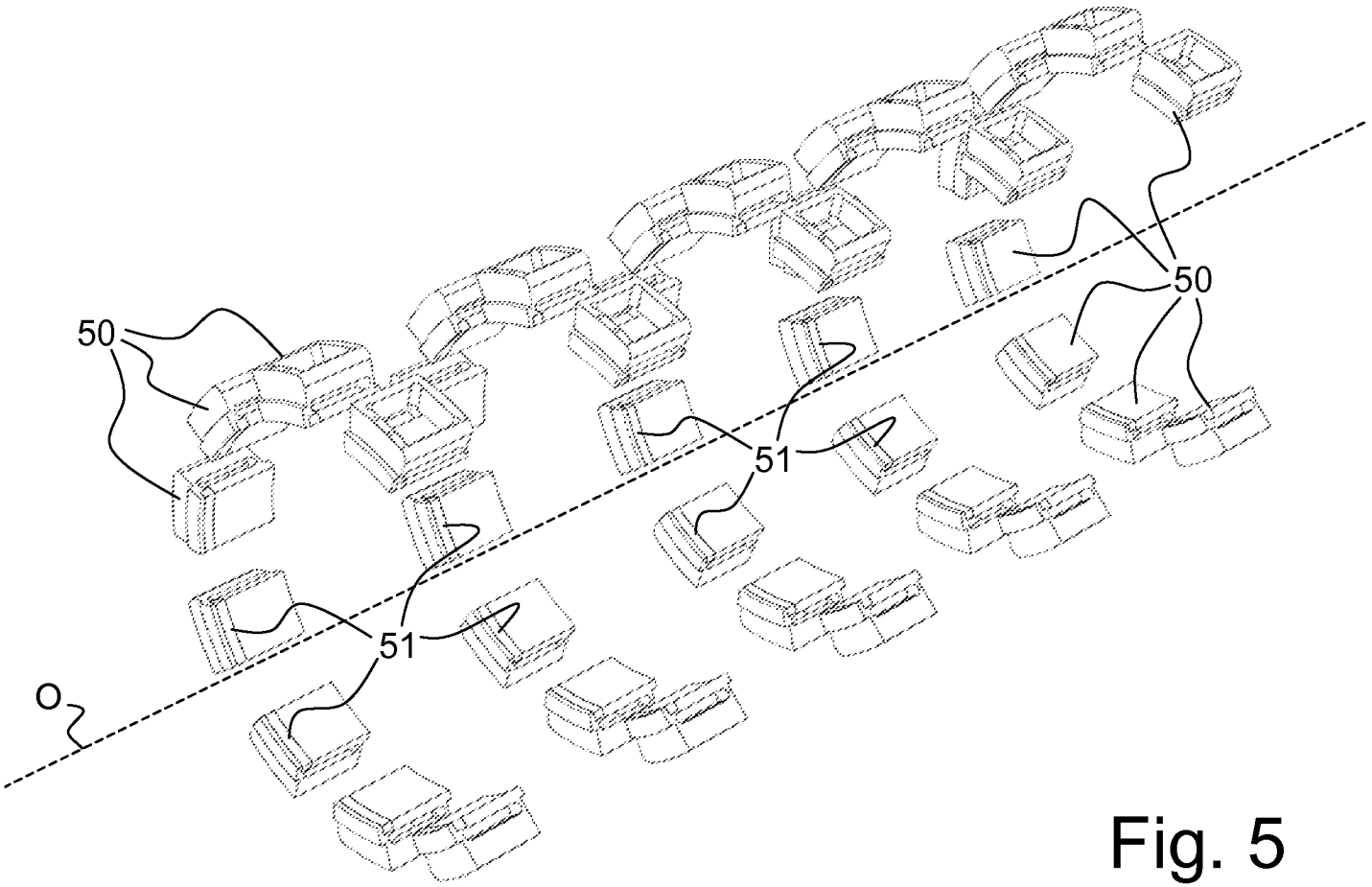
FIG. 5 is a schematic perspective view illustrating the arrangement of the magnetic-field-generating devices carried by the cylinder body of the first embodiment about the axis of rotation of the cylinder body shown by a dashed line.

FIG. 5 is a schematic illustration of the said supporting members 50 according to a possible mounting configuration about the axis of rotation O of the cylinder body 10. In FIG. 5, all the other elements of the cylinder body 10 have been omitted so as to show all the supporting members 50 in their mounting positions. In the illustrated embodiment, one may appreciate that eight supporting members 50 are provided on each annular supporting ring 40, thus totaling to forty supporting members 50, each designed to form a corresponding magnetic-field-generating device for cooperation with a corresponding one of forty different locations on the sheets being processed. According to the illustrated embodiment, one will therefore understand that the resulting cylinder body is adapted for cooperation with sheets on the surface of which an array of forty magnetic-flakes-containing patterns arranged in a matrix of five columns and eight rows has been printed. Such arrangement is obviously purely illustrative and other arrangements might be envisaged.

Referring again to FIG. 4, one may appreciate that the peripheral supporting shoulders 40*b* have a diameter such that the supporting members 50 (and accordingly the magnetic-field-generating devices as well) are almost completely enclosed between the supporting shoulders 40*b*. In other words, the supporting shoulders 40*b* are designed to provide a support on each side of the magnetic-field-generating devices, along the axis of rotation of the cylinder body 10.

As is also apparent from looking at FIG. 4, the peripheral mounting groove 40*a* preferably exhibits an inverted-T shape for insertion of the supporting members 50. Each supporting member 50 exhibits a corresponding T-shape matching that of the peripheral mounting groove 40*a*. As this will become apparent from the following, each supporting member 50 is preferably provided with its own clamping element 51 (visible in FIGS. 5, 7*a*, 8*b*, 9 and 10) adapted for cooperation with the peripheral mounting groove 40*a* of the annular supporting rings 40 for securing the magnetic-field-generating devices in place at any desired position along the peripheral mounting groove 40*a*. In this way, each magnetic-field-generating device can be adjusted freely along the circumference of the annular supporting rings 40, independently of the other magnetic-field-generating devices disposed on the same annular supporting ring 40.

FIGS. 6*a* and 6*b* are two views illustrating the common shaft member 20 which forms the remainder of the cylinder body 10 according to this first embodiment. The annular supporting rings 40 discussed above (as well as the additional ring 45) are mounted on this common shaft member 20 by way of their central opening 400 visible in FIGS. 3 and 4.

Preferably, each ring 40 (and 45) comprises an inner mounting groove 400*a* extending parallel to the axis of rotation O of the cylinder body 10. This inner mounting groove 400*a* is designed to enable mounting on the common shaft member 20 at a determined angular position about the common shaft member 20. To this end, a mounting bar (not shown) is secured to a longitudinal portion 20*a* of the common shaft member 20, which mounting bar cooperates with the inner mounting grooves 400*a* of the annular supporting rings 40. In this way, each annular supporting ring 40 is precisely positioned with respect to the common shaft member 20 and according to a same common angular reference position.

The supporting members 50 and annular supporting rings 40 are preferably made of aluminium, or any other material exhibiting a low magnetic permeability.

As illustrated in FIGS. 6*a*, 6*b*, the common shaft member 20 is preferably provided with a plurality of suction apertures 200 distributed axially and circumferentially on the outer circumference of the common shaft member 20. These suction apertures 200 are meant to communicate with corresponding suction outlets (to be discussed hereinafter) provided on the annular supporting rings 40.

In this example, each suction aperture 200 is advantageously designed as a threaded hole enabling selective closure thereof by means of corresponding plug elements, namely screwable elements in this case. This enables to selectively close unused apertures 200, namely apertures 200 which do not communicate with corresponding outlets of the annular supporting rings 40, i.e. the apertures 200 located between the annular supporting rings 40.

According to a preferred variant, as illustrated, the common shaft member 20 is provided with a plurality of independent suction channels 210 extending axially along the inside of the common shaft member 20. Each suction channel 210 communicates with a corresponding set of axially-distributed suction apertures 200 of the common shaft member 20. In the illustrated example, five suction channels 210 are provided, each channel 210 communicating with a corresponding set of apertures 200 (five rows of apertures 200 being provided on the circumference of the common shaft member 20).

Figure 7A:
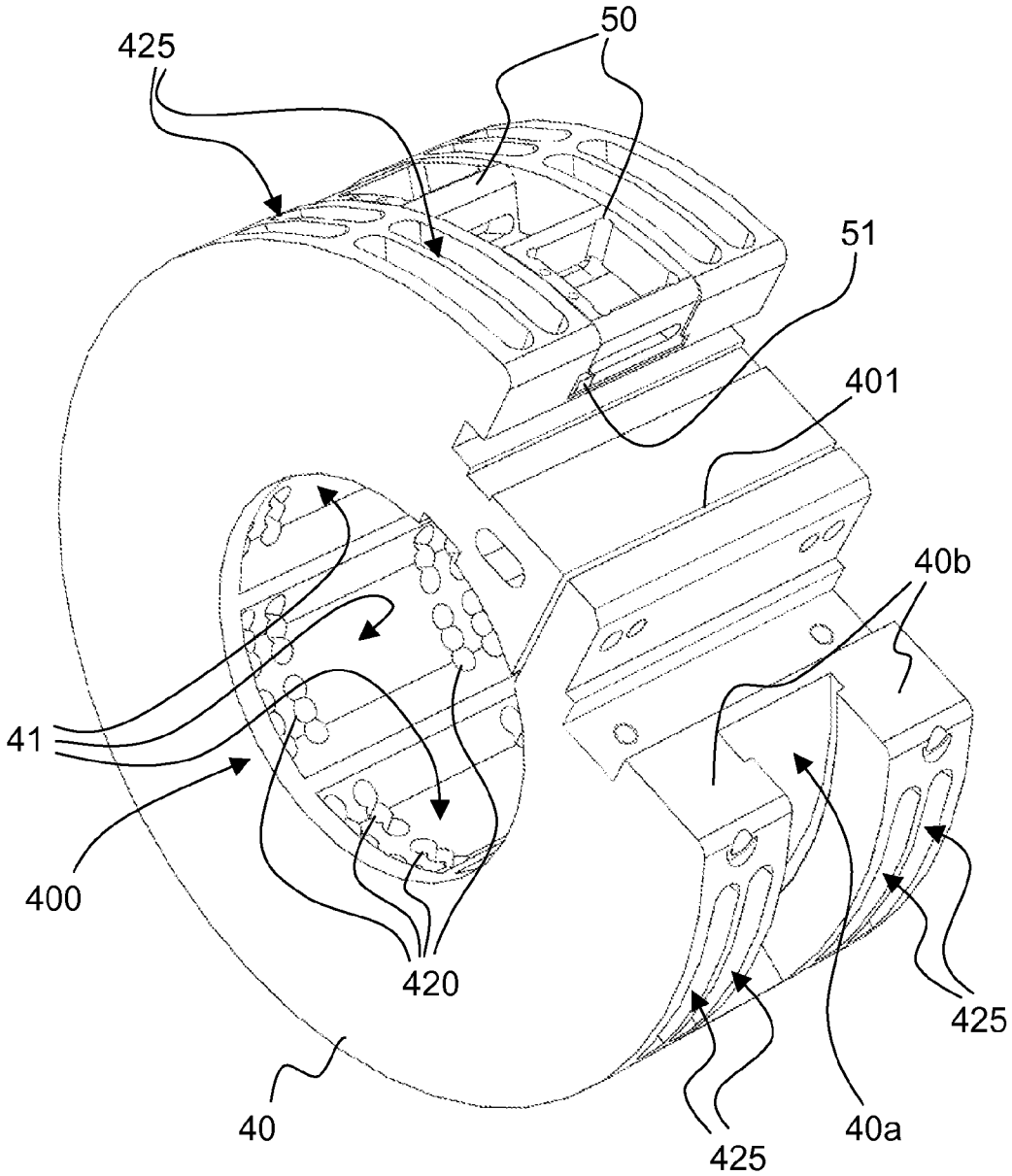
FIGS. 7*a* and 7*b* are two perspective views of one annular supporting ring taken along two different angles.
Figure 7B:
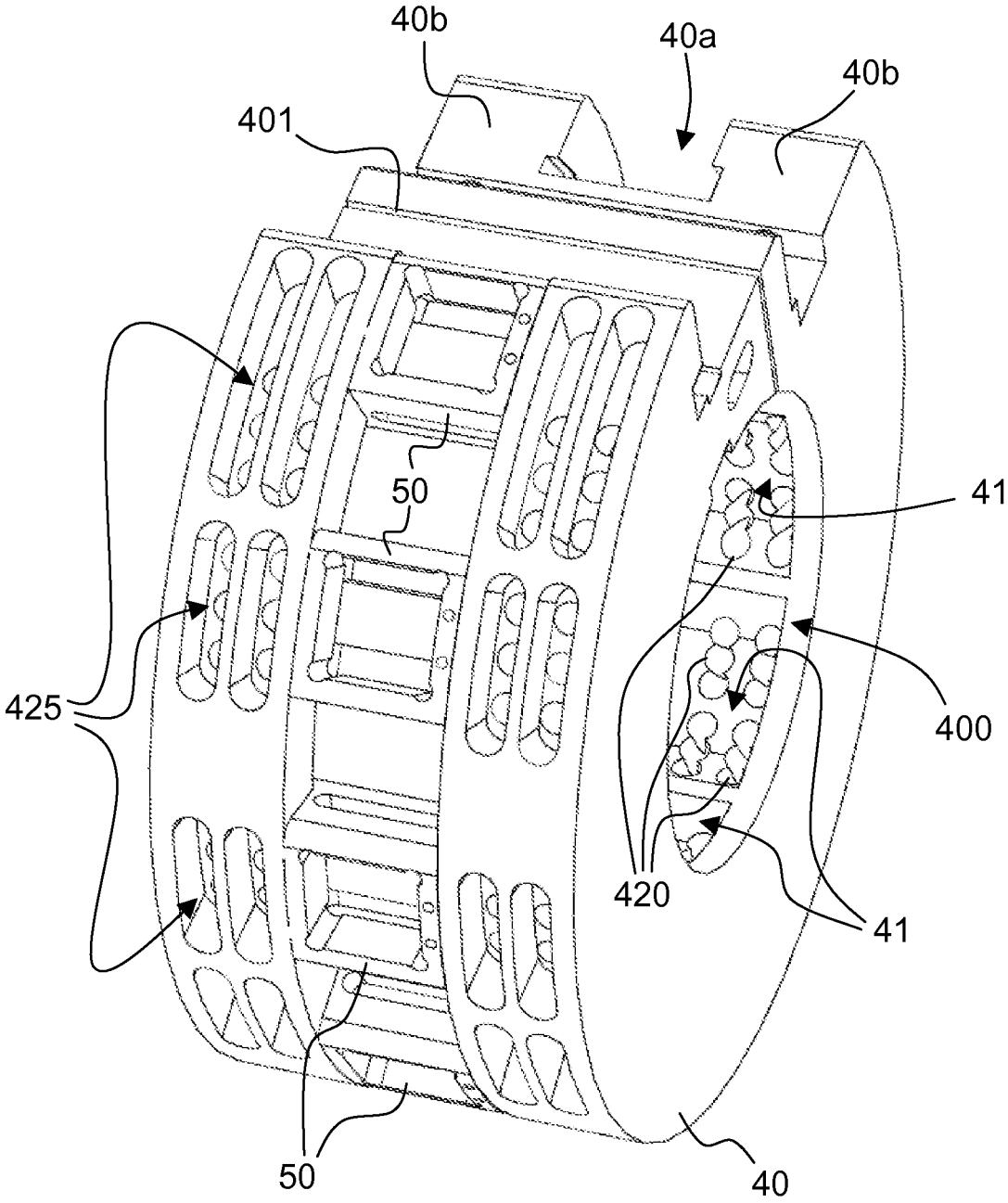

FIGS. 7*a* and 7*b* are two perspective views of one annular supporting ring 40 taken from two different angles. As is visible on these Figures (and in FIGS. 3 and 4 as well), each annular supporting ring 40 exhibits a generally annular shape interrupted by a radial opening slit 401. This radial opening slit 401 enables a slight elastic deformation of the annular supporting ring 40 in the circumferential direction so as to facilitate mounting and adjustment of the position of the supporting ring 40 on the common shaft member 20. Securing or releasing of the annular supporting ring 40 to or from the common shaft member 20 is ensured by appropriate assembly means (not shown in FIGS. 7*a* and 7*b*, but visible in FIG. 3), such as screws, which act on the radial opening slit 401 to cause closure or expansion thereof. One will accordingly appreciate that each annular supporting ring 40 is freely adjustable along the axis of the common shaft member 20, independently of the other annular supporting rings 40.

FIGS. 7*a* and 7*b* further show that each annular supporting ring 40 comprises a plurality of suction outlets 420 (also visible in FIGS. 3 and 4) opening in the inner opening 400 of the annular supporting ring 40. These suction outlets 420 communication with corresponding suction outlets 425 (also visible in FIG. 4) opening on the outer circumference of the annular supporting ring 40. One will understand that the suction outlets 420, 425 are designed to cooperate with the suction apertures 200 provided on the common shaft member 20.

Figure 8A:
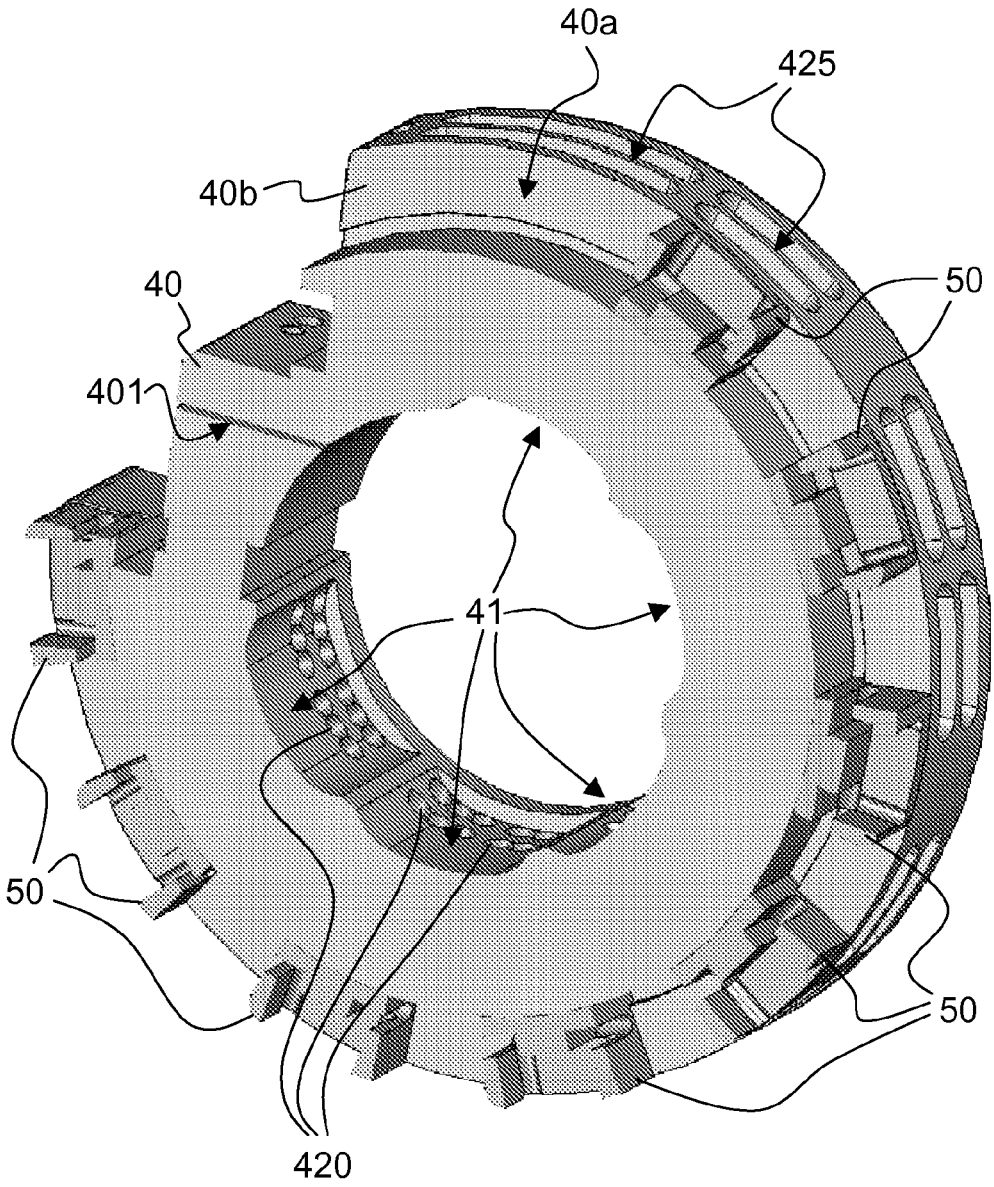
FIGS. 8*a* to 8*c* are three perspective views showing cross-sections of the annular supporting ring of FIGS. 7*a* and 7*b;*
Figure 8B:
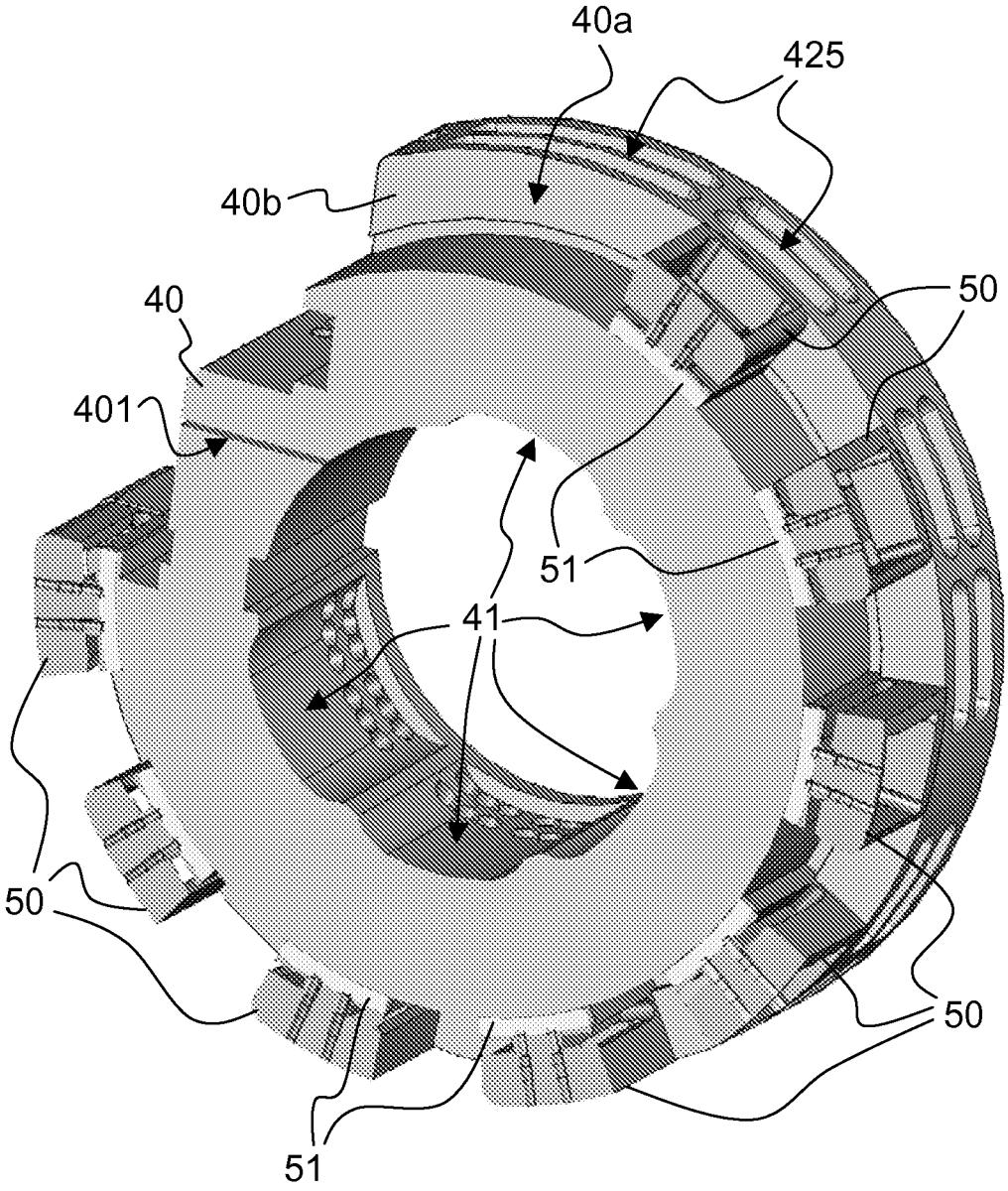

More precisely, independent suction chambers 41 are provided on the inner side of the annular supporting ring 40. Such independent suction chambers 41 are better visible in FIGS. 8*a*, 8*b*, 8*c* which are perspective views illustrating cross-sections of the annular supporting ring taken along three different planes perpendicular to the axis of rotation of the annular supporting ring 40. In FIGS. 8*a* and 8*b*, the cross-section are taken through the peripheral mounting groove 40*a*, while, in FIG. 8*c*, the cross-section is taken through one of the peripheral supporting shoulders 40*b*.

Figure 8C:
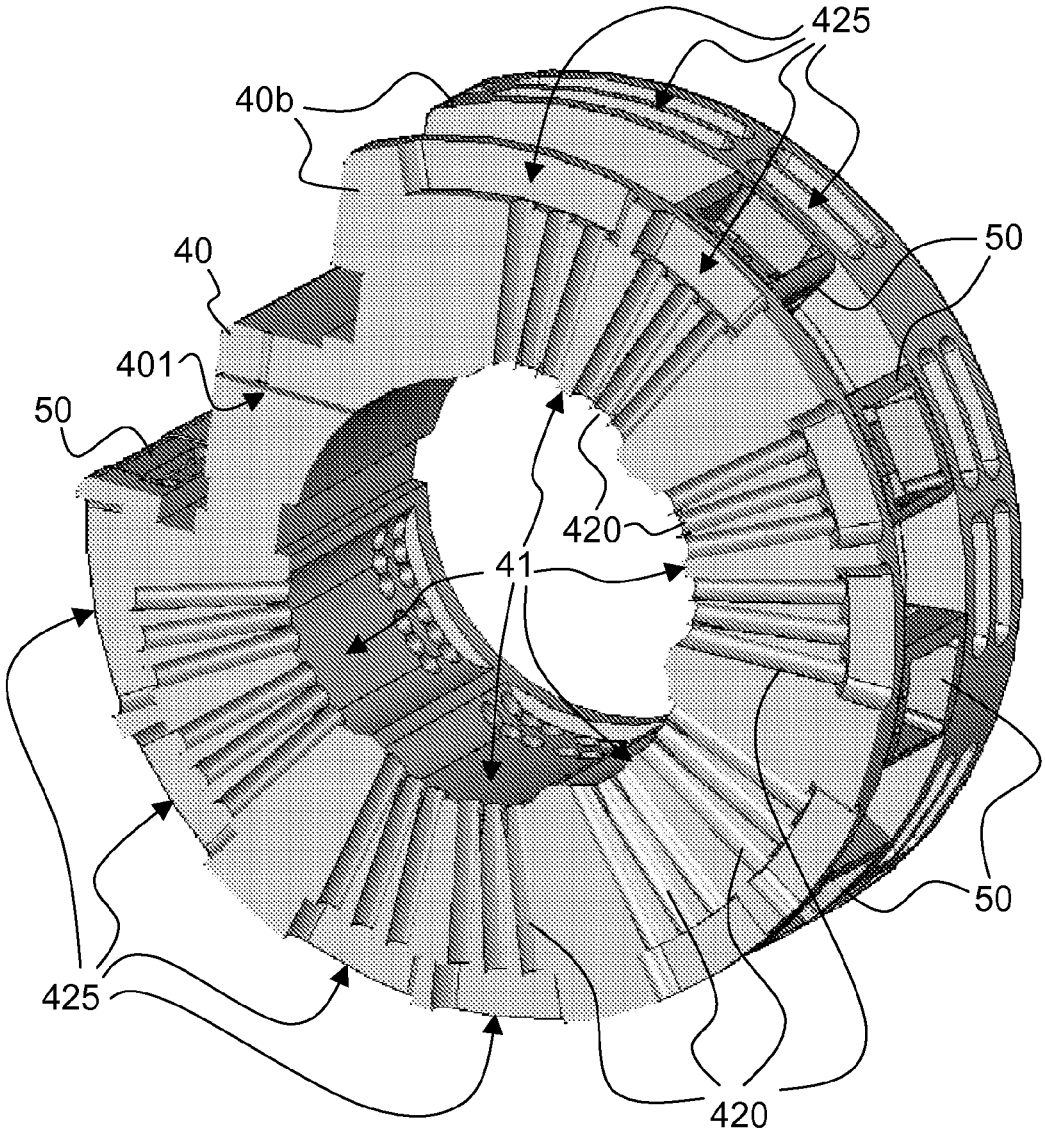

As is apparent in FIGS. 8*a*, 8*b*, 8*c*, five independent suction chambers 41 are provided on the inner side of the annular supporting ring. In each independent suction chamber 41, a corresponding set of suction outlets 420 is provided which communicate with the suction outlets 425 on the outer circumference of the annular supporting ring as illustrated in FIG. 8*c*.

Each suction chamber 41 is designed to cooperate with a corresponding one of the five sets of axially-distributed suction apertures 200 provided along the outer circumference of the common shaft member 20 illustrated in FIGS. 6*a*, 6*b*. In other words, each suction chamber 41 communicates with a corresponding one of the five suction channels 210 provided in the common shaft member 210 via the suction apertures 200. This configuration permits to apply suction to only part of the circumference of each annular supporting ring 40, and thus to a corresponding part of the circumference of the cylinder body 10.

In the illustrated embodiment, each suction channel 210 of the common shaft member 20 communicates with suction outlets 425 on the circumference of the annular supporting rings 40 (via the corresponding suction apertures 200, suction chambers 41 and suction outlets 420) and enables application of suction to sectors of the circumference of the cylinder body 10 of approximately 60° each. During operation, one or two suction channels 210 might be active at a same time to draw a corresponding portion of the surface of the sheet being processed against the outer circumference of the cylinder body 10.

In an advantageous implementation, the suction means disclosed hereinabove could furthermore be operated to briefly blow air to ease separation of the sheet being processed with the corresponding part of the circumference of the cylinder body 10.

As already discussed hereinabove, in the illustrated preferred embodiment, the supporting members 50 are inserted along the peripheral mounting groove 40*a* of the annular supporting rings 40, as for instance illustrated in FIGS. 8*a* and 8*b*. Each supporting member 50 is designed so as to be allowed to slide along the peripheral mounting groove 40*a* to adjust a circumferential position thereof. Once positioned, each supporting member 50 can be secured in place by means of a clamping element 51, as shown in FIGS. 8*b* and 9.

Figure 9:
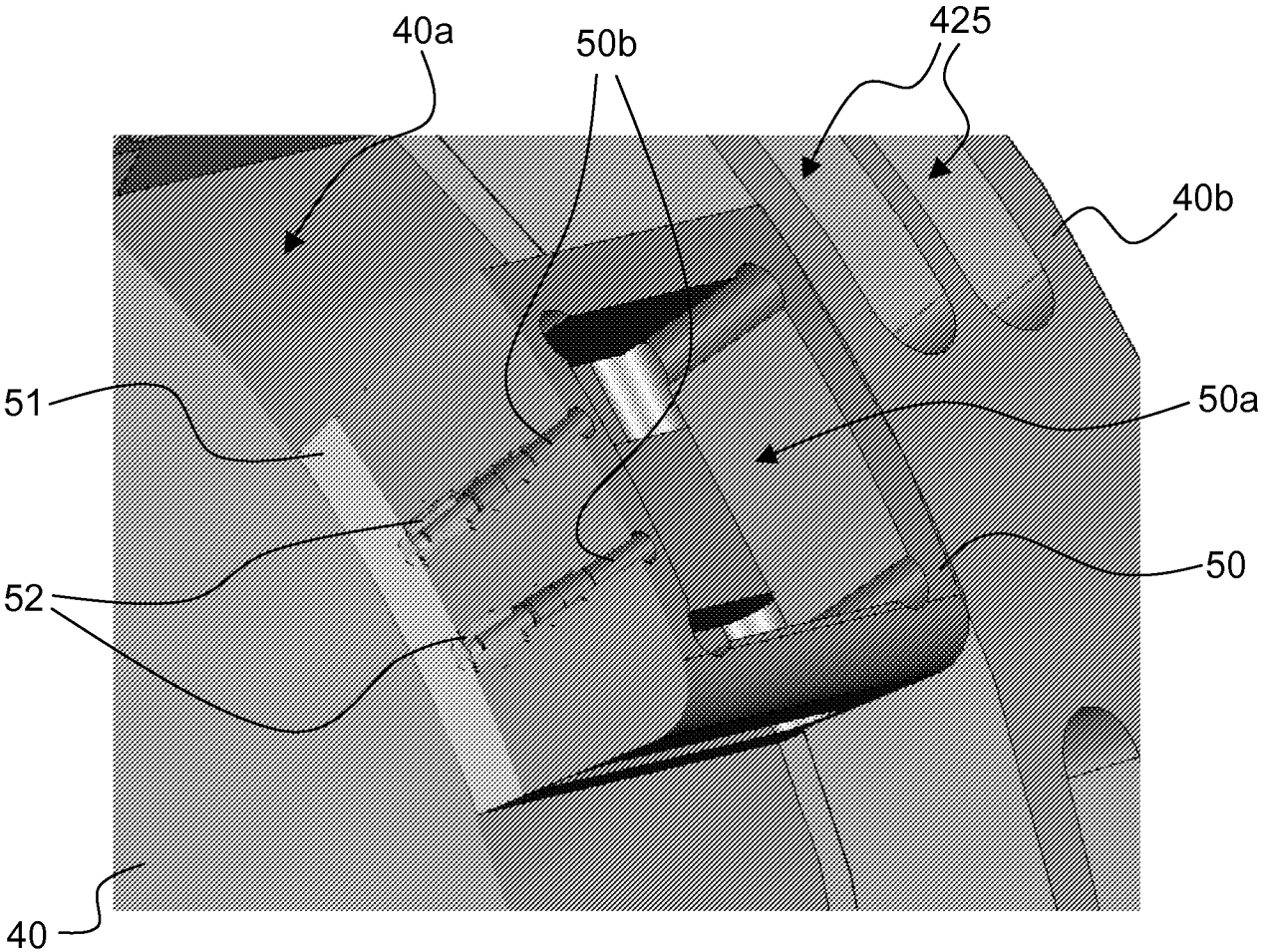
FIG. 9 illustrates in greater detail the mounting of a supporting member on the circumference of the annular supporting ring, which supporting member is intended to carry a magnetic element for orienting the magnetic flakes.

As shown in greater detail in FIG. 9, the clamping element 51 is shaped as a foot element disposed at the bottom of the supporting member 50 so as to cooperate with the peripheral mounting groove 40*a* of the annular supporting ring 40. A pair of threaded securing elements 52 cooperating with the clamping element 51 is provided in two through holes 50*b* of the supporting member 50, each threaded securing element 52 being accessible from the outer circumference using an adequate tool inserted in the corresponding through hole 50*b*. Each supporting element 50 can thus be secured in place by acting on the threaded securing elements 52 so that the clamping element 51 is urged towards the peripheral mounting groove 40*a* of the annular supporting ring 40. Conversely, each supporting member 50 can be released from its position by releasing the clamping pressure exerted by the clamping element 51.

Advantageously, as illustrated in FIG. 3, in the preferred embodiment comprising the cover plate 101, openings 101*c* enabling access to the through holes 50*b* of the supporting elements 50 are further provided next to the rectangular openings 101*a* so as to permit fine adjustment of the position of each supporting element 50, if necessary, after the cover plate 101 is mounted.

Figure 10:
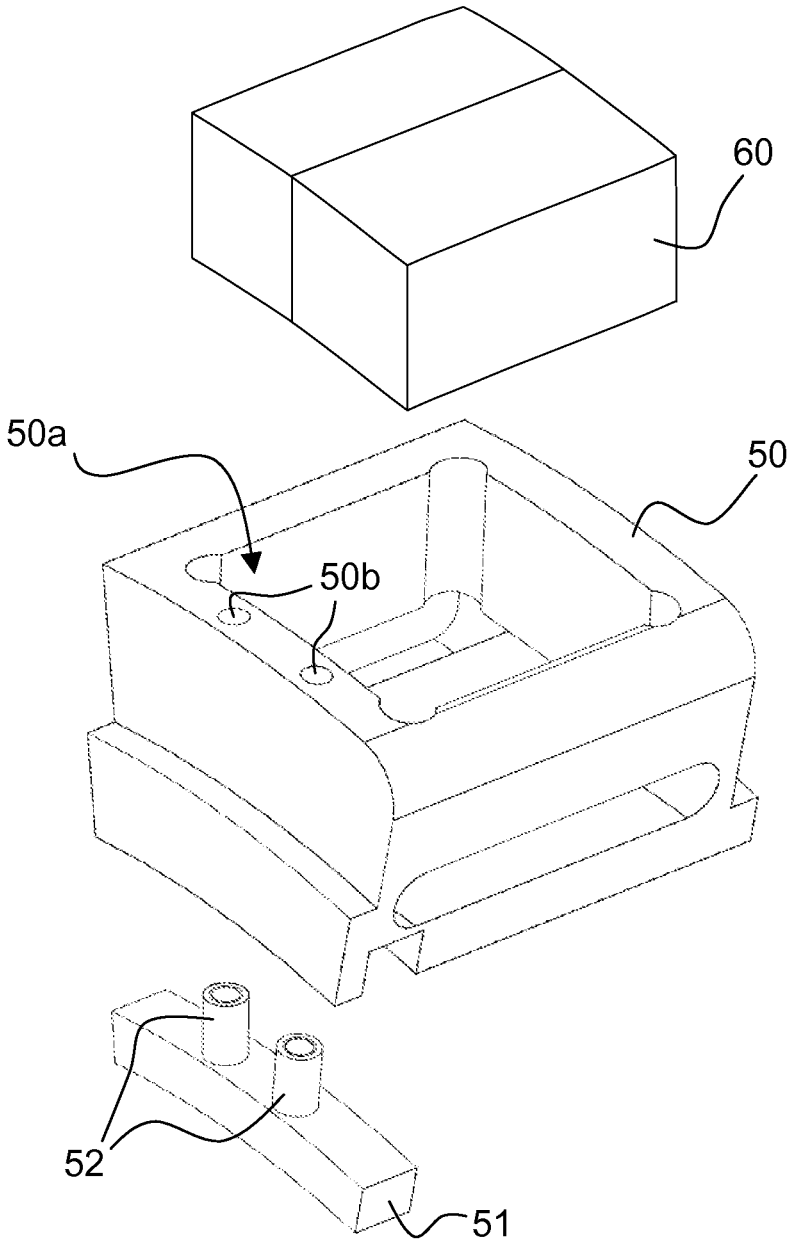
FIG. 10 is a perspective view of the supporting member of FIG. 9 shown in isolation.

FIG. 10 is an exploded perspective view of the supporting member 50 with its clamping element 51 and threaded securing elements 52. Also shown in FIG. 10 for the purpose of illustration is a magnet-field-inducing element 60 that is placed in a corresponding opening 50*a* of the supporting member 50.

The magnet-field-inducing element 60 can be as simple as a permanent magnet as illustrated in FIG. 4 of International application WO 2005/000585 or a device comprising a body of permanent magnetic material the surface of which is engraved to cause perturbations of its magnetic field as discussed in International application WO 2005/002866. Within the scope of the present invention, the magnet-field-generating devices can be any type of device susceptible of producing a magnetic field capable of orienting the magnetic flakes contained in the ink/varnish patterns applied on the substrate to be processed.

Various modifications and/or improvements may be made to the above-described embodiments without departing from the scope of the invention as defined by the annexed claims. For instance, while the invention was described in the context of a printing press adapted for sheet printing, the invention is equally applicable to the printing on a continuous web of material.

In addition, while the cylinder body illustrated in the Figures comprises a cover plate, such cover plate is only preferred. Within the scope of the present invention, the cover plate could be replaced by intermediate supporting discs placed in the gaps between the annular supporting rings.

Lastly, while silk-screen printing is a preferred printing process for applying the ink/varnish patterns contained the magnetic flakes to be oriented, other printing process might be envisaged, such as the intaglio printing process as discussed in European patent application EP 1 650 042. In other words, the cylinder body of the present invention can be used in printing presses other than silk-screen printing presses.

The invention claimed is:

1. A cylinder body for orienting magnetic flakes contained in an ink or varnish vehicle applied on a sheet-like or web-like substrate, which cylinder body has a plurality of magnetic-field-generating devices disposed on an outer circumference of the cylinder body, wherein said cylinder body further comprises a plurality of distinct annular supporting rings distributed axially along a common shaft member, each annular supporting ring carrying a set of said magnetic-field-generating devices which are distributed circumferentially on an outer circumference of the annular supporting rings, wherein each annular supporting ring is freely adjustable along the axis of the common shaft member and can be secured in place individually onto the common shaft member, independently of the other annular supporting rings.

2. The cylinder body according to claim 1, wherein each annular supporting ring has a generally annular shape interrupted by a radial opening slit extending axially through the annular supporting ring and is provided with assembly means acting on said radial opening slit for securing or releasing the annular supporting ring to or from the common shaft member.

3. The cylinder body according to claim 1, wherein each annular supporting ring comprises an inner mounting groove extending parallel to an axis of rotation of the cylinder body for mounting on the common shaft member at a determined angular position about the common shaft member.

4. The cylinder body according to claim 1, further comprising a cover plate made of a material having a low magnetic permeability, which cover plate is secured on said annular supporting rings and covers said magnetic-field-generating devices.

5. The cylinder body according to claim 4, wherein said cover plate is provided with openings at locations corresponding to the positions of said magnetic-field-generating devices.

6. The cylinder body according to claim 4, further comprising first and second clamping means for securing and tensioning said cover plate around the annular supporting rings.

7. The cylinder body according to claim 1, wherein each magnetic-field-generating device comprises a supporting member made of a material having a low magnetic permeability for receiving a corresponding magnetic-field-inducing element, which supporting member is mounted on the annular supporting ring.

8. The cylinder body according to claim 7, wherein each supporting member comprises a clamping element for securing the supporting member to the annular supporting rings.

9. The cylinder body according to claim 1, wherein each magnetic-field-generating device is freely adjustable along the circumference of the annular supporting rings, independently of the other magnetic-field-generating devices disposed on the same annular supporting ring.

10. The cylinder body according to claim 9, wherein each annular supporting ring is provided with a peripheral mounting groove for mounting of the magnetic-field-generating devices, said peripheral mounting groove preferably exhibiting an inverted-T shape.

11. The cylinder body according to claim 10, wherein each annular supporting ring comprises a pair of peripheral supporting shoulders extending on each side of the annular mounting groove, which peripheral supporting shoulders have a diameter such that the magnetic-field-generating devices are almost completely enclosed between said peripheral supporting shoulders.

12. The cylinder body according to claim 11, wherein said common shaft member includes a plurality of suction apertures distributed axially and circumferentially on an outer circumference of the common shaft member, which suction apertures communicate with corresponding suction outlets provided on said annular supporting rings and opening on the outer circumference of the annular supporting rings and wherein said suction outlets open on an outer circumference of the peripheral supporting shoulders.

13. The cylinder body according to claim 1, wherein said common shaft member includes a plurality of suction apertures distributed axially and circumferentially on an outer circumference of the common shaft member, which suction apertures communicate with corresponding suction outlets provided on said annular supporting rings and opening on the outer circumference of the annular supporting rings.

14. The cylinder body according to claim 13, wherein said suction apertures on the common shaft member can be selectively closed by corresponding plug elements disposed in said suction apertures.

15. The cylinder body according to claim 13, wherein said common shaft member includes a plurality of independent suction channels extending axially along a length of said common shaft member, each independent suction channel communicating with a corresponding set of axially-distributed suction apertures of the common shaft member, and wherein each annular supporting ring comprises a plurality of inner independent suction chambers each communicating with a corresponding one of said independent suction channels of the common shaft member.

16. The cylinder body according to claim 1, for cooperation with a chain gripper system of a sheet-fed printing press, wherein a clearance is provided on part of the circumference of the annular supporting rings for receiving a protruding portion of a gripper bar of said chain gripper system.

17. A printing press comprising a cylinder body according to claim 1.

18. The printing press according to claim 17, wherein said printing press is a silk-screen printing press.

19. The printing press according to claim 17, wherein said cylinder body is located in a delivery section of the printing press.

* * * * *

UNITED STATES PATENT AND TRADEMARK OFFICE

CERTIFICATE OF CORRECTION

PATENT NO. : 8,499,687 B2
APPLICATION NO. : 12/527580
DATED : August 6, 2013
INVENTOR(S) : Matthias Gygi et al.

It is certified that error appears in the above-identified patent and that said Letters Patent is hereby corrected as shown below:

Title page, Item [75] Inventor: Delete "Gygy" and insert -- Gygi --.

Signed and Sealed this
First Day of October, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,499,687 B2
APPLICATION NO. : 12/527580
DATED : August 6, 2013
INVENTOR(S) : Matthias Gygi et al.

It is certified that error appears in the above-identified patent and that said Letters Patent is hereby corrected as shown below:

Title Page, Item [12] Delete "Gygy" and insert -- Gygi --.

Signed and Sealed this
Thirty-first Day of December, 2013

Margaret A. Focarino

Margaret A. Focarino
*Commissioner for Patents of the United States Patent and Trademark Office*